US005640879A

United States Patent [19]

Damsohn et al.

[11] Patent Number: 5,640,879

[45] Date of Patent: Jun. 24, 1997

[54] METHOD AND DEVICE FOR EXPANDING METAL TUBES

[75] Inventors: Herbert Damsohn, Aichwald; Werner Helms; Roland Hemminger, both of Esslingen; Walter Wolf, Oppenweiler, all of Germany

[73] Assignee: Behr GmbH & Co., Stuttgart, Germany

[21] Appl. No.: 312,267

[22] Filed: Sep. 26, 1994

[30] Foreign Application Priority Data

Sep. 25, 1993 [DE] Germany ..... 43 32 768.0
Dec. 22, 1993 [DE] Germany ..... 43 43 820.2

[51] Int. Cl.[6] ..... B23P 15/26

[52] U.S. Cl. ..... 72/479; 29/727; 29/890.044; 72/391.2

[58] Field of Search ..... 72/370, 391.2, 72/391.4, 479, 480; 29/727, 890.044, 890.047

[56] References Cited

U.S. PATENT DOCUMENTS 2,023,738 12/1935 Mason et al. ..... 29/727
2,916,077 12/1959 Fuchs, Jr. ..... 72/479
3,482,299 12/1969 Davidson et al. ..... 29/890.047
4,524,600 6/1985 Champoux et al. ..... 72/391.4
4,631,813 12/1986 Daniels et al. ..... 29/727
4,745,678 5/1988 Gray ..... 29/890.044
4,930,338 6/1990 Tokura ..... 72/479

FOREIGN PATENT DOCUMENTS 2122928 1/1984 United Kingdom ..... 29/890.044

*Primary Examiner*—Lowell A. Larson
*Attorney, Agent, or Firm*—Foley & Lardner

[57] ABSTRACT

A method and a device for the draw expansion of metal tubes of oval cross-section uses expansion elements drawn unidirectionally through metal tubes by means of draw elements. The expansion elements are fastened to the draw elements by suspension devices which have a hammer-like contour. The draw elements are preferably made of a rod-shaped material. An apparatus of the invention is an apparatus for mechanically expanding metallic tubes, in particular tubes in heat exchangers. Each individual tube to be expanded is held in at least one holding device and passed through by a drawing mandrel with an expanding element. To prevent jamming of the expanding element in one of the holding devices, the holding devices are provided with lateral guides which are resiliently compliant outward in the radial direction. When the expanding element passes through the metallic tube, the tube is expanded in the radial direction. The forces occurring thereby in the axial direction are absorbed by the holding device, since the tube is seated on a stop in the holding device.

20 Claims, 11 Drawing Sheets

METHOD AND DEVICE FOR EXPANDING METAL TUBES

BACKGROUND OF THE INVENTION

The invention relates to a method and device for expanding metal tubes, particularly metal tubes of oval cross-section, to fasten the metal tubes to metal ribs.

It is known from EP-B1 188 314 to connect metal tubes of oval or elliptical cross-section and metal ribs to one another by mechanically expanding the metal tubes. Here, expansion elements are pushed through the metal tubes, the expansion operation taking place in two stages.

A similar single-stage expansion method and a device in the form of an expansion mandrel having an expansion head and a thrust rod is disclosed by DE-A-27 05 632.

A disadvantage in the above-mentioned prior art is that the metal tubes are under compressive load during the expansion and can consequently bend out or buckle. Leakages can occur at the tube-plate connection due to this bending or buckling of the tubes. The mandrel rod is likewise under compressive load. Here, too, there is a risk of buckling, the expansion element tilting in the metal tube and the expansion of the tube becoming uneven.

The present invention also relates to an apparatus for mechanically expanding metallic tubes, in particular tubes in heat exchangers, the apparatus including a drawing mandrel with an expanding element and a holding device. It is suitable, for example, for a process for producing heat exchangers, such as that described in the first part of the present invention. For each tube to be expanded, such an apparatus has a drawing mandrel with an expanding element and at least one holding device. The tubes are pre-expanded at their ends and fitted into the holding device. Subsequently, the tube is passed through by the drawing mandrel and the expanding element, the tube being expanded. The pre-expanding is necessary in order that the expanding element can be passed completely through the tube and does not jam in the holding device. The pre-expanding of the tubes is an independent operation and consequently a not inconsiderable cost factor.

SUMMARY OF THE INVENTION

An object of the invention is therefore to improve the method of fastening metal tubes to metal ribs in such a way that metal tubes of relatively great length can also be mechanically connected to metal ribs. In addition, it is an object of the invention to provide a device for carrying out the method, which device is suitable, in particular, for flat oval tubes.

These and other objects of the first part of the invention are achieved by a method of fastening metal tubes to metal ribs, comprising the step of drawing expansion elements unidirectionally through the metal tubes to plastically deform the metal tubes and deform the metal ribs. The drawing step may include the step of drawing the expansion elements by means of draw rods and elastically deforming the metal ribs. Preferably, the drawing step includes the step of drawing the expansion elements through metal tubes having oval cross-sections.

The inventive method may further comprise the steps of expanding the metal tubes in at least one of their end areas; pushing a draw rod having an expansion element attached thereto into each metal tube; and pushing the metal tubes with the pushed-in draw rods into corresponding openings of a metal rib pack.

In one aspect, the method includes, before the drawing step, the step of supporting the metal tubes in a holder at tube ends which are remote from initial positions of the expansion elements, so that the metal tubes are subjected to a compressive load during the drawing step.

In another aspect the method includes, before the drawing step, the step of clamping the metal tubes in a holder at tube ends which are adjacent initial positions of the expansion elements, so that the metal tubes are subjected to a tensile load during the drawing step.

In a further aspect the method includes the step of drawing expansion elements having two draw rods opposite one another, unidirectionally in a first direction through first metal tubes and unidirectionally in a second direction through second metal tubes, a tensile force being transmitted to the expansion elements via draw rods connected to sides of the expansion elements, which sides correspond to a drawing direction.

The apparatus of the invention includes, in a first aspect, a device for fastening metal tubes to metal ribs, comprising an expansion element having at one end a suspension device having a hammer-like contour.

A second aspect of the inventive apparatus includes a device for fastening metal tubes to metal ribs, comprising an expansion element having at one end a mounting device having two hooks pointing toward a centerline of the expansion element.

In its first aspect, the expansion element may include at an opposite end a second suspension device having a hammer-like contour.

In its second aspect, the expansion element may include at an opposite end a second mounting device having two hooks pointing toward the centerline of the expansion element.

The first aspect of the device may further comprise a draw rod having at one end a mounting device for engaging with the hammer-like contour of the suspension device of the expansion element, the mounting device having hooks pointing to a centerline of the draw rod.

The second aspect of the device may further comprise a draw rod having at one end a suspension device having a hammer-like contour for engaging with the mounting device of the expansion element.

An object of the apparatus of the invention is to provide an apparatus for mechanically expanding metallic tubes such that the metallic tubes can be expanded completely in one operation.

These and other objects of the invention are achieved by an apparatus for mechanically expanding metallic tubes, comprising at least one drawing mandrel having an expanding element at one end thereof and at least one holding device having an insertion funnel and a stop, for holding a metallic tube to be expanded by the expanding element wherein the holding device includes lateral guides which are resiliently compliant outward in the radial direction. Preferably, the holding device includes, in a region of the lateral guides, at least one incision in the axial direction wherein the lateral guides are connected in one piece with the holding device and are resiliently compliant outward.

Advantageously, the apparatus also includes a base plate, a holding plate, a plurality of holding devices having holding rings and arranged on the base plate at the same axial spacing as the metallic tubes to be expanded, wherein the holding devices are firmly clamped by their holding rings between the base plate and the holding plate.

Another aspect of the invention is an apparatus for mechanically expanding metallic tubes comprising at least one drawing mantrel having an expanding element at one end thereof and at least one holding device for holding a metallic tube to be expanded by the expanding element, the holding device including a bead around an internal periphery thereof, wherein the holding device includes lateral guides which are resiliently compliant outward in the radial direction.

Further objects, features, and advantages of the invention will become apparent from the following detailed description taken in conjunction with the accompanying drawings.

BRIEF DESCRIPTION OF THE DRAWINGS

The drawings are hereby expressly made a part of the specification. The invention is shown in the drawings with reference to exemplary embodiments, in which.

DETAILED DESCRIPTION OF THE PREFERRED EMBODIMENTS

Figure 1A:
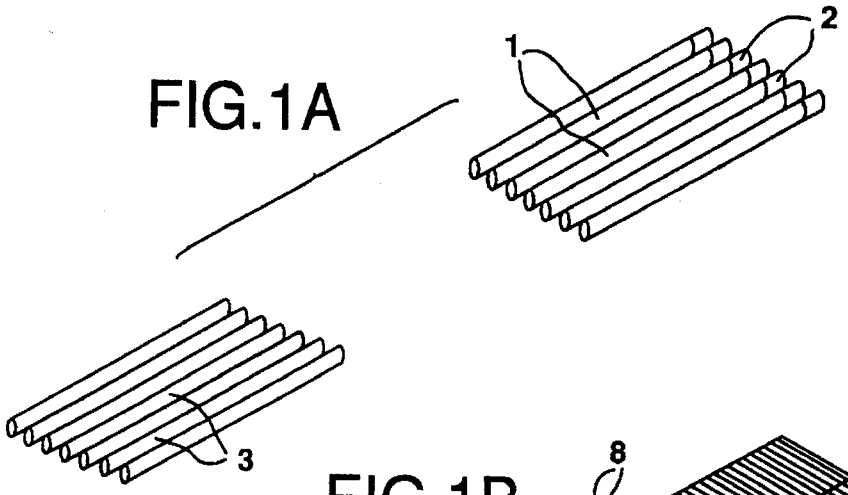
FIGS. 1(*a*)–(*d*) show the step-by-step sequence of the method.
Figure 1B:
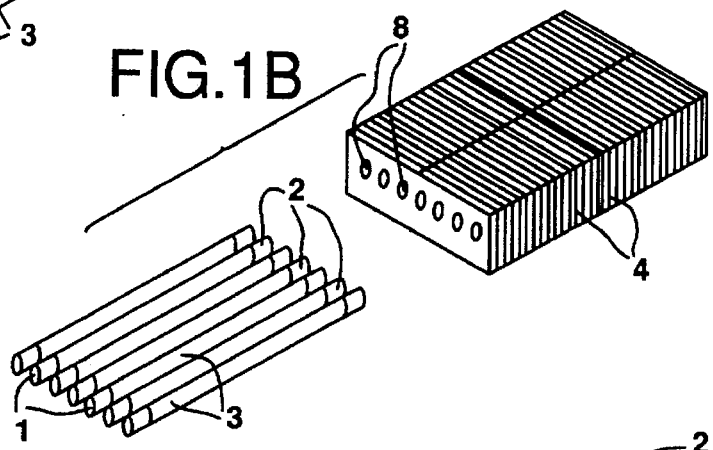
Figure 1C:
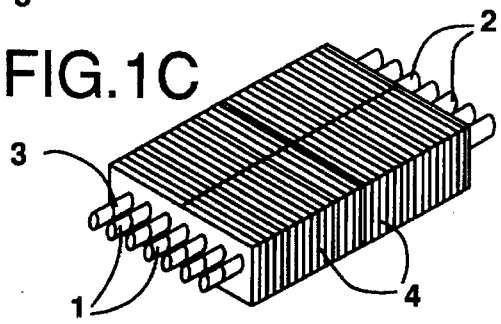
Figure 1D:
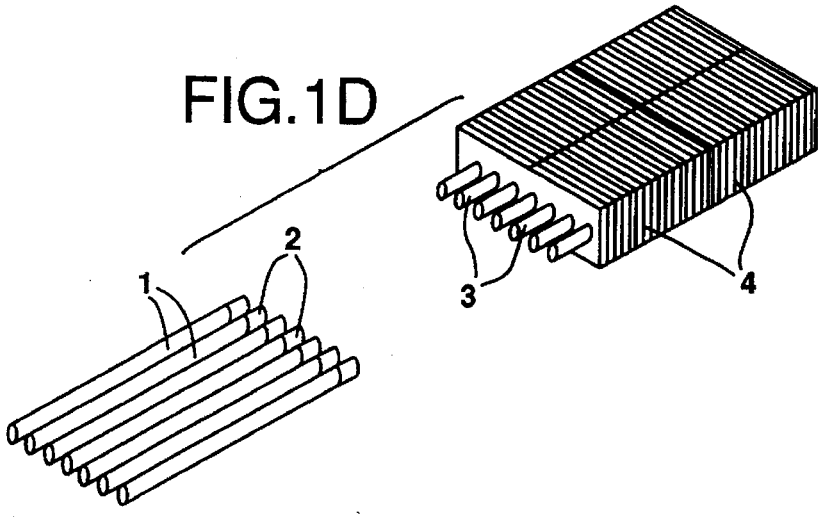

The invention includes a method and device which are suitable for expanding metal tubes of oval cross-sections, where oval cross-section means a tube cross-section which has a larger main axis and a smaller secondary axis, in particular oval or elliptical cross-sections.

In a broad aspect of the invention, expansion elements should be fastened to corresponding draw elements and they should be drawn merely in one direction through the metal tubes to be expanded, their buckling being impossible due to the tensile stress of the draw elements. Resulting as a further advantage from the single drawing of the expansion elements through the metal tubes is the fact that the expansion elements are exposed to less wear than is the case in a conventional fabrication method in which the expansion elements are pushed through the metal tubes and are then pulled back again. In particular, when the expansion elements are pulled back out of the metal tubes, the expansion elements can seize in the metal tubes, since a lubricant which has been applied to the expansion elements before the expansion is already consumed during the first pass through the metal tubes.

In one aspect of the invention, the metal tubes are pre-expanded at at least one of their ends, a special pre-expansion element being used for this purpose. Holding means can be advantageously attached to these pre-expanded areas during the subsequent expansion operation, which holding means can absorb the tensile or compressive forces in the axial direction which act on the metal tubes when the expansion elements are being drawn through. In each case a draw rod with an expansion element fastened thereto is pushed into the metal tubes prepared in this way, the expansion elements projecting from one end of the metal tubes. Since the expansion elements have a rounded form, they advantageously serve as insertion aids during the pushing of the metal tubes into the openings of a metal rib pack, catching of the metal tubes in the metal ribs being prevented. The expansion elements are then drawn through the metal tubes in one direction by means of the draw rods.

In another aspect of the invention, the metal tubes are clamped in holders during the expansion operation with their clamped ends remote from the initial position of the expansion elements. The compressive forces arising when the expansion elements are being drawn through the metal tubes are absorbed by the above-mentioned holders.

In yet another aspect of the invention, the metal tubes are clamped in holders during the expansion operation with their clamped ends facing or adjacent the expansion elements. The tensile forces occurring when the expansion elements are being drawn through the metal tubes are absorbed by the above-mentioned holders. This development is especially advantageous, since merely tensile forces occur in the metal tubes so that the tubes cannot buckle even when they are of great lengths.

In still another aspect of the invention, a tube plate is arranged at least on one tube outlet side of the metal rib pack, the pushed-in metal tubes extending through this tube plate. The tube plate and the metal ribs are connected to the metal tubes in one expansion operation, as a result of which an additional operation for fastening the tube plates can be dispensed with.

Preferably, elastic seals are additionally inserted into the tube plates before the expansion, so that the seals are pressed against the enclosed tube and into the openings of the tube plate by the expansion. Leakages which could be caused by roughness or the like on the seals are thereby compensated for.

In a further aspect of the invention, two draw rods opposite one another are fastened to the expansion element. In a suitable machine, the expansion element can now be drawn alternately in a forward direction and a reverse direction through tubes to be expanded. Here, the draw rod lying at the front is pushed during the forward movement into a metal tube and the latter in turn is inserted during the forward movement into the openings of the metal rib pack. The metal rib pack and the metal tube are now seized and held in place by holding devices. The draw rod lying at the front, the expansion element and the rear draw rod continue to be drawn in the forward movement through the metal tube and out of the latter, the tensile force acting on the front draw rod. The finished rib block is now removed from the machine. During the reverse movement, the rear draw rod not used hitherto is pushed into a new metal tube and is pushed with the latter into the openings of a further metal rib pack. The metal rib pack and the metal tube are again seized and held in place by holding devices, and the expansion element is drawn through the metal tube by means of the draw rod which was previously the rear draw rod. After the finished rib block is removed, the machine is free for a new cycle. The idle travel and idle times of the machine are drastically reduced by this method and the costs incurred are accordingly reduced.

In accordance with the present invention, the expansion element has at one end or at both ends a suspension device having a hammer-like contour. In one aspect, the expansion element is provided at one end or at two ends opposite one another with a mounting device which has two hooks directed to the inside. Preferably, the suspension and mounting devices of the expansion elements are put together with corresponding mounting and suspension devices of the draw rods by means of which the expansion element is drawn through the metal tube. A time-consuming screw fastening is not necessary in this variant or in any other variant according to the invention. This development of the suspension device on the expansion element and of the associated mounting device on the draw rod is especially advantageous in the case of tube cross-sections which are of very flat configuration, thus the draw rods and expansion elements according to the invention can be used, for example, at axial ratios of 1:3, 1:10 up to 1:20 and above. In addition, the expansion elements can be exchanged very easily, since they are held in the mounting devices merely via an interference fit.

In a further aspect of the invention, the suspension and mounting devices of the expansion elements and draw rods have undercuts. The hooks and the suspension device are thereby connected to one another in a positive-locking manner, as a result of which bending-up of the mounting device under tensile load is prevented, so that the hooks do not need to be made especially rigid, thus also not so thick, as a result of which the expansion elements and draw rods can also be used in extremely slender metal tubes. Preferably, the undercuts are located on the underside of the suspension device or on the top side of the hooks of the mounting device. The ends of the hooks are thereby widened and can no longer be pulled sideways out of the connection with the suspension device. This effect can be intensified if the opposite sections of the suspension and mounting device are likewise made with corresponding undercuts. In the combination of these embodiments, the ends of the hooks are finally formed in a T-shape and enclose a suspension device of corresponding configuration, the extensions of the hooks also engaging in the shoulders of the expansion element.

In a preferred embodiment, the expansion element is movably fastened to the draw rod, in which case it can move back and forth in a circular arc shape by a certain angle on the main axis. Due to this embodiment, the expansion element can be oriented automatically in the metal tube during the drawing, and thus the draw means no longer has to guide the draw rod so exactly in the metal tube.

Preferably, the draw rod is designed as a band-shaped draw rod. The advantage of such a development consists in the fact that the draw rod and the expansion element connected thereto are easy to manipulate, for example, for pushing the draw rods into the metal tubes. In addition, the metal tubes are supported from inside by the draw rod during the expansion. This is especially of advantage when the metal tubes are under compressive load during the expansion, since buckling of the tubes can thereby be prevented or at least reduced. This effect is further intensified if the band-shaped draw rod has roughly the form and the internal dimensions of the metal tube before the forming operation. For easier manipulation and simpler adjustment in the drawing machine, the draw rods are preferably flattened at their longitudinal sides.

FIGS. 1*a–d* show the individual steps of the method for mechanically connecting metal tubes 3 of oval cross-section to a metal rib pack 4. Here, draw rods 1, in whose mounting device 22 (not shown here) expansion elements 2 are inserted, are pushed into the metal tubes 3 to such an extent that the metal tubes 3 sit on or abut the expansion elements 2 (FIG. 1*a*). The metal tubes 3 have been pre-expanded at one end or both ends in a preparatory operation. The ends of the draw rods 1 protrude from the metal tubes 3 on the side of the metal tubes 3 which is opposite the expansion elements. These ends of the draw rods 1 are provided with suitable devices with which they can be seized by a drawing machine. The metal tubes 3 with the pushed-in draw rods 1 are now pushed with the expansion elements 2 in front into the openings 8 of a metal rib pack 4 (FIG. 1*b*), in the course of which the expansion elements 2, due to their rounded form, facilitate the insertion of the metal tubes into the metal rib pack 4. The metal tubes 3 are then oriented in the metal rib pack 4 (FIG. 1*c*), are fixed in this position in the metal rib pack 4 and are seized at the pre-expanded ends 7 by a holding device 51 or 514 or 61 (See FIGS. 9–14). In the last working step shown here (FIG. 1*d*), the expansion elements 2 are pulled with their draw rods 1 through the metal tubes 3, in the course of which the metal tubes are expanded and the desired mechanical connection with the metal rib pack 4 is produced.

Figure 2A:
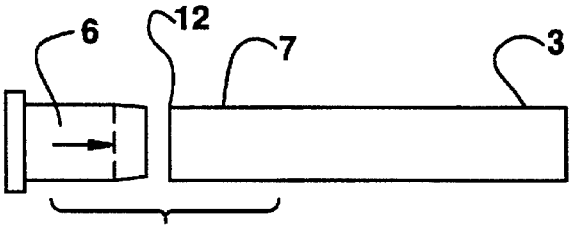
FIGS. 2(*a*)–(*h*) show the expansion principle of the draw expansion, tubes under compressive load.
Figure 2B:
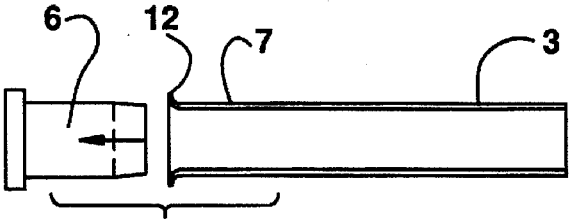
Figure 2C:
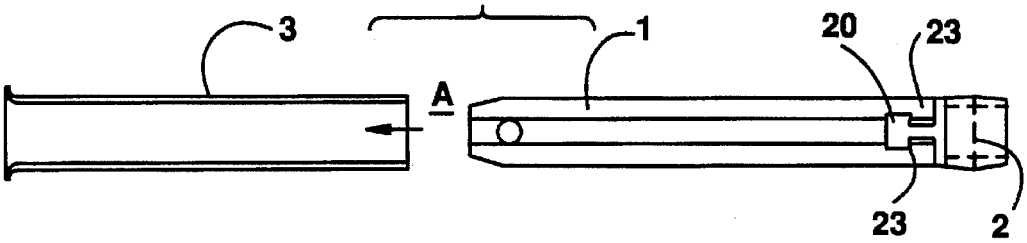
Figure 2D:
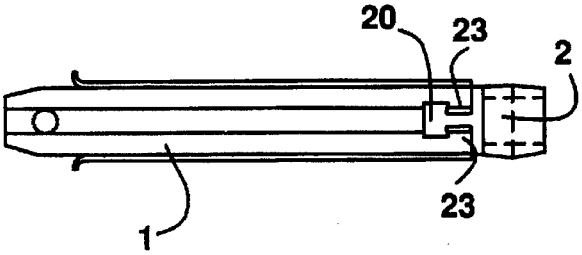
Figure 2E:
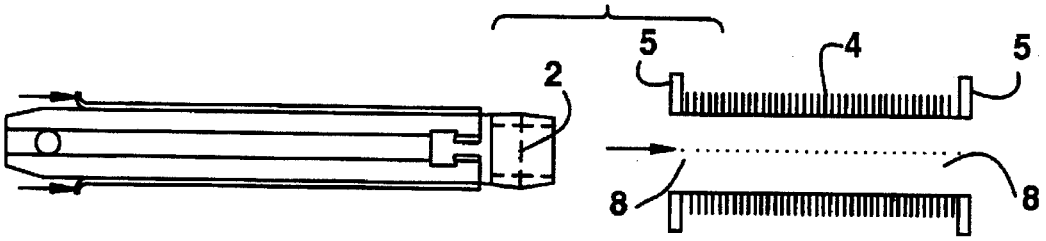
Figure 2F:
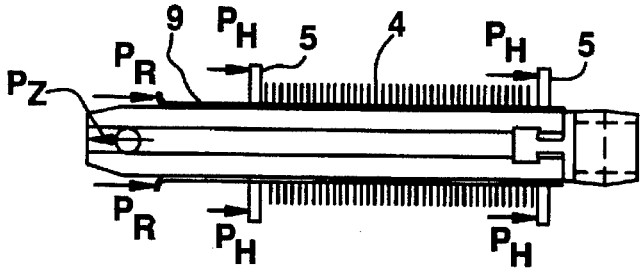
Figure 2G:
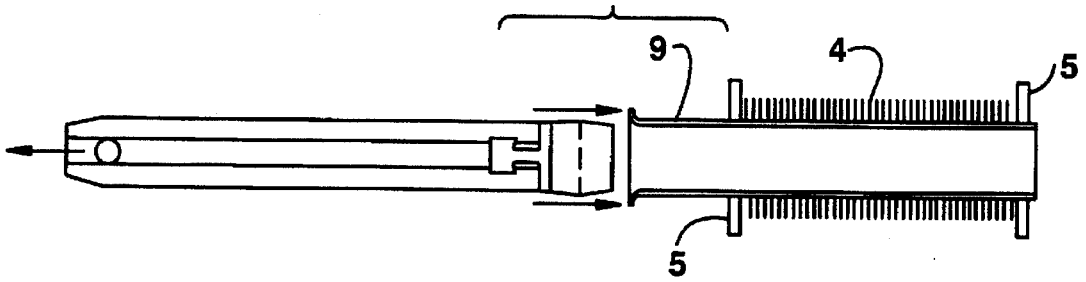
Figure 2H:
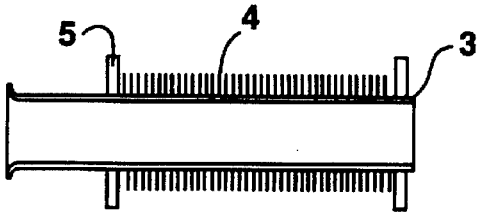

FIGS. 2*a–h* and FIGS. 3*a–g* represent the principle of the draw expansion, the metal tube 3 being under compressive load in FIGS. 2*a–h* and under tensile load in FIGS. 3*a–g*. The pre-expansion of the metal tube 3 is shown in FIGS. 2*a* and 2*b*. Here, the end area 7 of the metal tube 3 is expanded with a pre-expansion element 6, and the rim 12 is additionally provided with beading. The pre-expansion element 6 is pulled out of the metal tube 3 again. The draw rod 1 with the expansion element 2 is then pushed into the metal tube 3 (FIG. 2*c*) until the metal tube 3 sits on or abuts the expansion element 2 (FIG. 2*d*). In the process, the expansion element 2, by means of an interference fit, is suspended with the suspension device 20 into the mounting device of the draw rod 1, consisting of the hook 23. The metal tube 3 thus prepared is now pushed with the expansion element 2 in front through the opening of a tube plate 5 into the opening 8 of the metal rib pack 4 and a further tube plate 5 (FIG. 2*e*) and is oriented there. The tube plates 5, the metal rib pack 4 and the metal tube 3 are then clamped in holders 51 or 514 (See FIGS. 9–13) which can absorb the forces occurring when the expansion element 2 is being drawn through the metal tube 3. The holding forces $P_H$ which act on tube plates 5 and the metal rib pack 4 are very small as a result. The retaining force $P_R$ acts on the end 9 of the metal tube 3, as a result of which the metal tube 3 is loaded by compression in the axial direction. The draw rod 1, on the other hand, is only stressed by tension by the tensile force $P_Z$ (FIG. 2*f*). FIGS. 2*g* and 2*h* show the end of the expansion method. The metal tube 3 is expanded and the metal rib pack 4 and the tube plates 5 are fixed thereon. The draw rod 1 and the expansion element 2 are pulled completely out of the metal tube 3 and are available for a renewed expansion cycle.

Figure 3A:
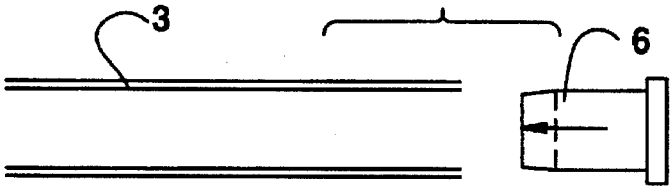
FIGS. 3(*a*)–(*g*) show the expansion principle of the draw expansion, tubes under tensile load.
Figure 3B:
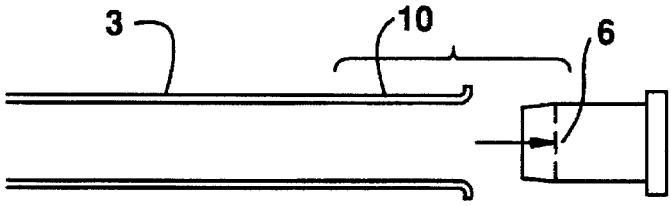
Figure 3C:
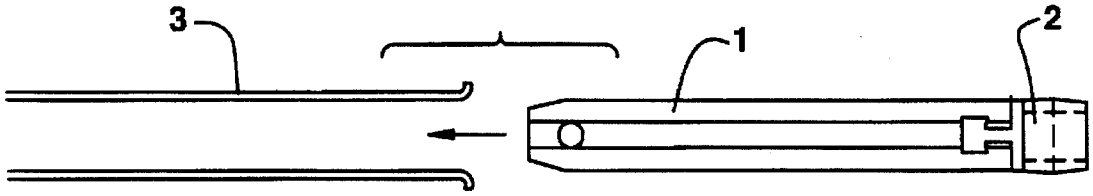
Figure 3D:
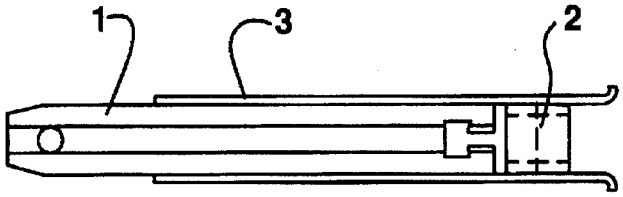
Figure 3E:
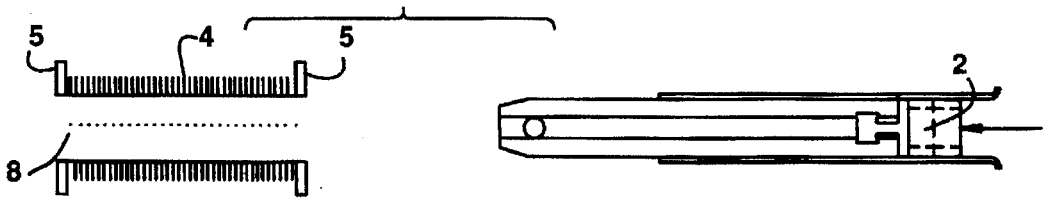
Figure 3F:
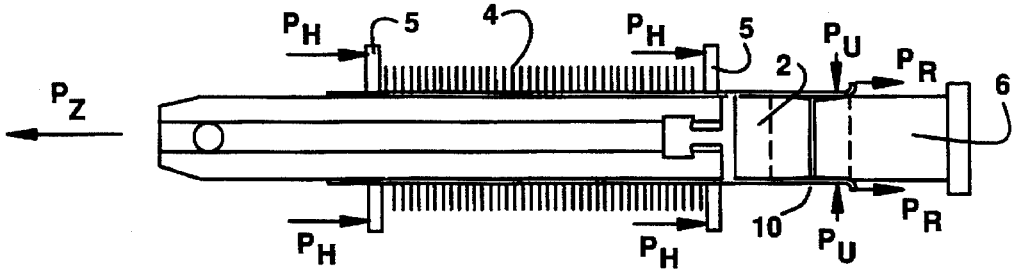
Figure 3G:
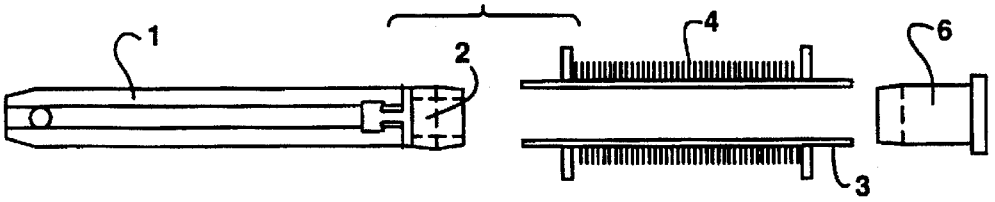

FIGS. 3*a–g* likewise show the principle of the draw expansion, but here the metal tube 3 is loaded by tension. FIGS. 3*a* and 3*b* show the preliminary expansion of one end 10 of the metal tube 3. The pre-expansion element 6 is again removed from the metal tube 3. The draw rod 1 and the expansion element 2 are now pushed into the metal tube 3 (FIG. 3*c*) until the metal tube 3 sits on or surrounds the expansion element 2 with the tube section which is not pre-expanded (FIG. 3*d*). The expansion element 2 is thereby already pushed fully into the metal tube 3. Metal tube 3, draw rod 1 and expansion element 2 are pushed with the draw rod 1 in front into the opening 8 of the metal rib pack 4 and two tube plates 5 (FIG. 3*e*) and are oriented there. The tube plates 5 and the metal rib pack 4 are clamped in holders, the holding forces $P_H$ which occur being very small. To absorb the retaining force $P_R$ which occurs at the metal tube 3 during the expansion, a pre-expansion element 6 is pushed into the tube end 10 of the metal tube 3. A holder 61 (See FIG. 14) can now act on the tube end, which holder 61 produces a force $P_U$ acting on the periphery of the metal tube 3, so that the force $P_R$, acting in the axial direction and produced by the drawing of the expansion element 2 with the tensile force $P_Z$ through the metal tube 3, is transmitted to the holder 61 by friction contact (FIG. 3*f*). Finally, the pre-expansion element 6 is removed from the metal tube 3, whereby the expansion operation is completed (FIG. 3*g*).

Figure 4A:
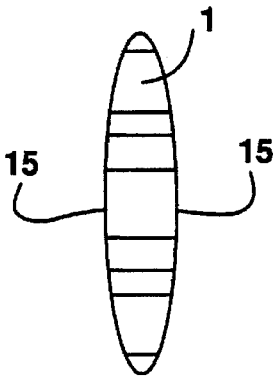
FIGS. 4(*a*) and 4(*b*) show the mounting device of a draw rod.
Figure 4B:
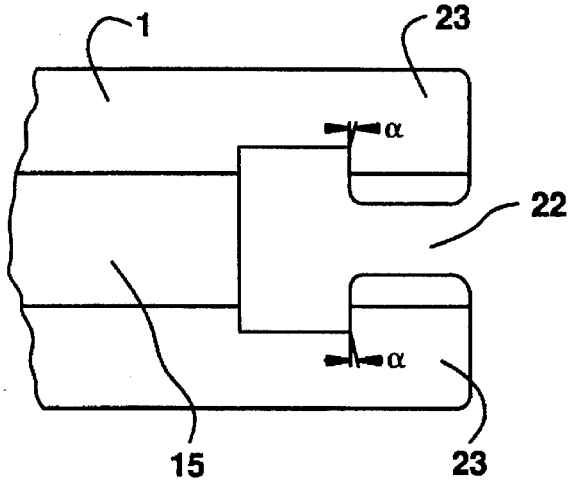

FIGS. 4*a* and 4*b* show the mounting device 22 of a band-shaped draw rod 1, consisting of two hooks 23 pointing to the inside. The top sides of the hooks 23 are undercut by the angle α. The space enclosed by the mounting device 22 has a hammer-like contour which corresponds to the contour of the suspension device 20. The dimensions of the mounting device 22 are fit sizes which form an interference fit with the associated suspension device. The cross-section of the draw rod 1 corresponds approximately to the cross-section of the metal tube 3 in the non-expanded state. On its longitudinal sides, the draw rod 1 is provided with flats 15 which substantially facilitate the manipulation of the draw rod 1 (FIG. 4*a*).

Figure 5:
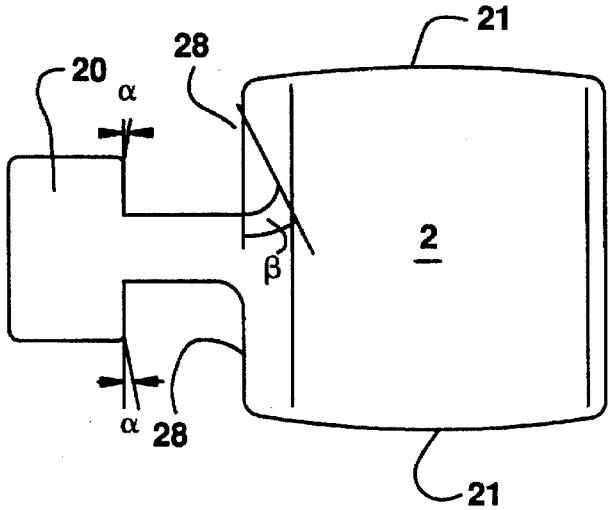
FIG. 5 shows the suspension device of an expansion element.

FIG. 5 shows the suspension device 20 of the expansion element 2. It has a hammer-like contour and is undercut at its undersides by the angle α. In addition, the shoulders 28 of the expansion element 2 can also be undercut on both sides of the transition to the suspension device 20, in which case the undercut angle β can assume a value of 5° to 25° (See upper shoulder 28 in FIG. 5). The expansion element 2 and the suspension device 20 are made in one piece. The flanks 21 of the expansion element 2 are convexly ground, their greatest distance from one another determining the greatest possible expansion of the metal tubes 3.

Figure 6:
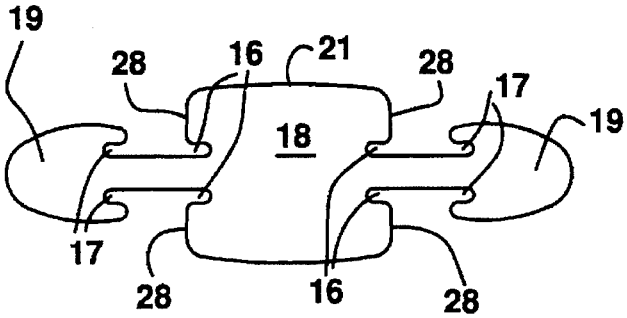
FIG. 6 shows an expansion element with two suspension devices.

FIG. 6 shows an expansion element 18 with two suspension devices 19. The suspension devices 19 are rounded on their top side, as a result of which a favorable direction of the lines of force is achieved. They are undercut on their underside, the undercut 17 being made roughly in a U-shape. The shoulders 28 of the expansion element 18 likewise have U-shaped undercuts 16 at the transitions to the suspension devices 19. The flanks 21 are convexly ground.

Figure 7:
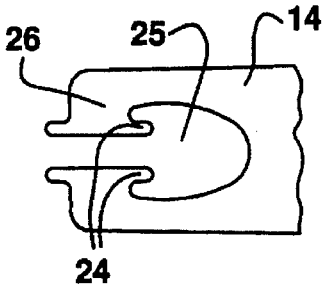
FIG. 7 shows the mounting device of a draw rod.

FIG. 7 shows the mounting device 25 of a draw rod 14. Here, the hooks 26 are provided with barbs 24, rounded in a U-shape and pointing to the inside, and extensions 27 likewise rounded in a U-shape, so that the ends of the hooks 26 run out roughly in a T-shape. This shape of the hooks 26 corresponds to the corresponding shaped portion of the suspension device 19 of the expansion element 18 (FIG. 6), as a result of which the hooks 26 are connected to the suspension device 19 by positive locking. The tensile forces which are transmitted from the draw rod 14 to the expansion elements 18 when used as intended cannot therefore lead to the bending-up of the hooks 26.

Figure 8A:
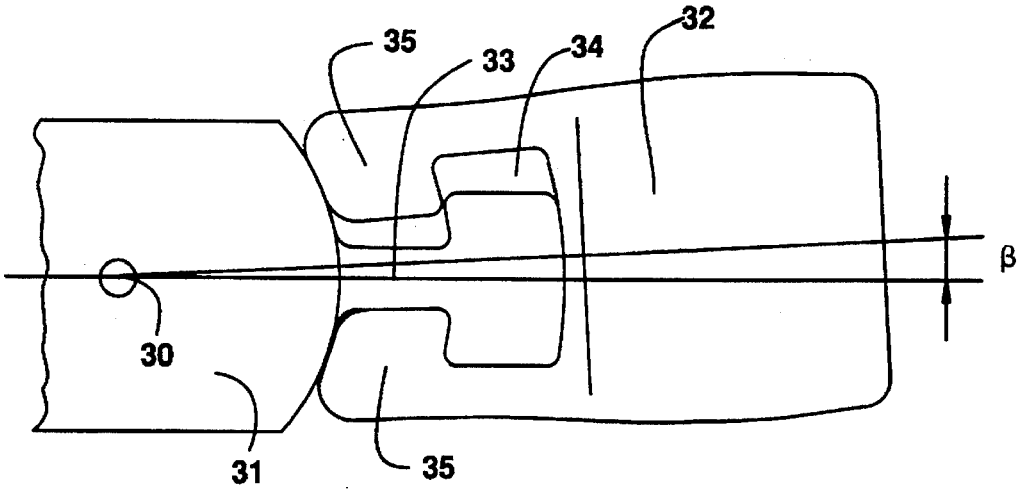
FIGS. 8(*a*)–(*c*) show a draw rod having a movably mounted expansion element.
Figure 8B:
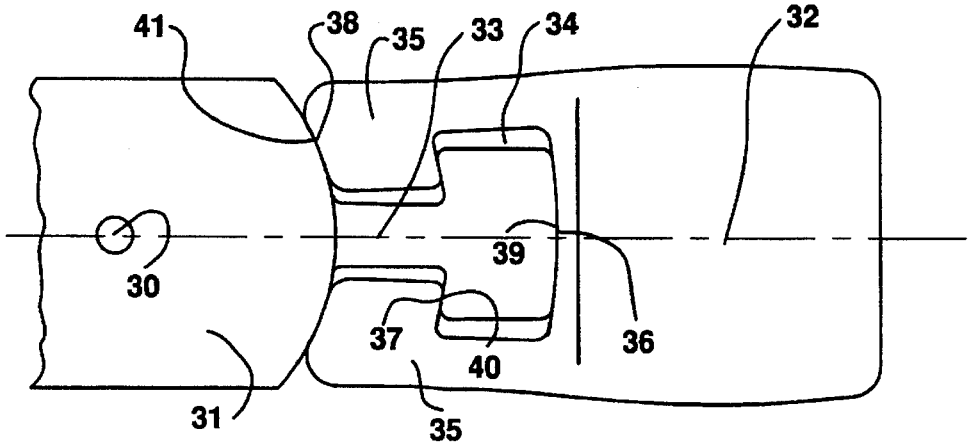
Figure 8C:
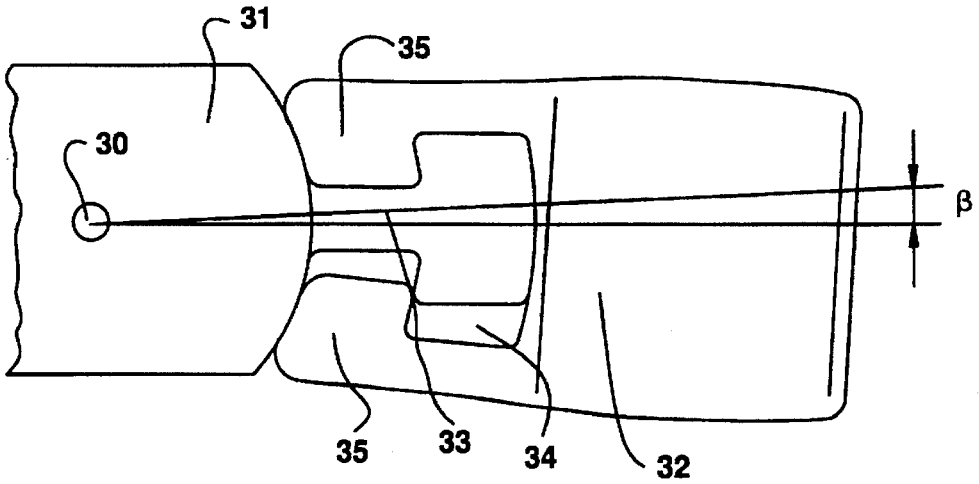

FIGS. 8*a–c* show a draw rod 31 having a movably mounted expansion element 32. Here, the mounting device 34 of the expansion element 32 has lateral clearance relative to the suspension device 33 so that the expansion element 32 can be moved back and forth about the pivot 30. The head 36, the undercuts 37 on the underside of the suspension device 33 and the shoulders 38 on both sides of the transition from the draw rod 31 to the suspension device 33 are configured in a circular arc shape, the pivot 30 also being the centre point of these corresponding circular arcs. The mounting device 34 of the expansion element 32 has a shape corresponding thereto, but it is cut out to such an extent that the expansion element 32 can swing by an angle β about the pivot 30. Here, too, the head area 39, the hook inner surface 40 and outer surface 41 are made in a circular arc shape, the radius of these circular arcs corresponding to the respective distance from the pivot 30. FIG. 8*b* shows the expansion element 32 connected to the draw rod 31, in the centre position, whereas FIGS. 8*a* and 8*c* show the expansion element 32 in each case in the position deflected to the maximum extent by the angle β.

The present invention also includes an apparatus for mechanically expanding metallic tubes including a drawing mandrel with an expanding element and a holding device with an insertion funnel and a stop. In this case, the holding device is designed such that its lateral guides can yield resiliently outward in the radial direction. For expanding the tube, the tube is then fitted into the holding device, without pre-expansion, and passed through by the drawing mandrel and the expanding element. In this operation, the tube is expanded in the radial direction. The forces in the axial direction are absorbed by the holding device, since the tube is seated on a stop in the holding device. If, when passing through the tube, the expanding element reaches the end region of the tube, by which the latter is fitted in the holding device, the lateral guides are pressed outward by the expanding element, as a result of which the opening cross section of the holding element is enlarged in such a way that the expanding element can be passed completely through the tube. The costly pre-expansion is consequently dispensed with completely.

Advantageously, the holding device is provided in the region of the lateral guides with an incision, as a result of which the lateral guides can spring radially outward. The lateral guides are connected in one piece with the foot of the holding device and act like leaf springs, as a result of which a tube which is fitted into the holding device is centered centrally in the holding device. Preferably, the incision has at its foot an additional bore, as a result of which the notching effect of the incision and at the same time the resilient effect of the lateral guides are reduced. In this way, the force which is exerted by the lateral guides on the held tube can be set in a broad range.

In a preferred embodiment, the holding device comprises at least two radially outwardly movable holding elements which are provided with lateral guides and are pressed by springs toward the center axis of the holding device. The type of springs may in this case be chosen freely, according to the size of installation space, thus for example cup springs, leaf springs or helical springs may be used. The holding elements are connected to the holding device by special guides or by the springs.

In yet another preferred arrangement, a plurality of holding devices are arranged on a base plate at the same spacing as that exhibited by the tubes to be expanded of the heat exchanger block. The holding devices are in this case firmly clamped by their holding rings between the base plate and a holding plate. The holding plate advantageously has recesses in the region of the holding rings, so that the holding devices are secured by a form fit against lateral displacement. By the arrangement of all the required holding devices on one base plate and the use of a corresponding number of drawing mandrels with the respective expanding element, the expanding of all the tubes of a heat exchanger block can take place in one action.

Figure 9:
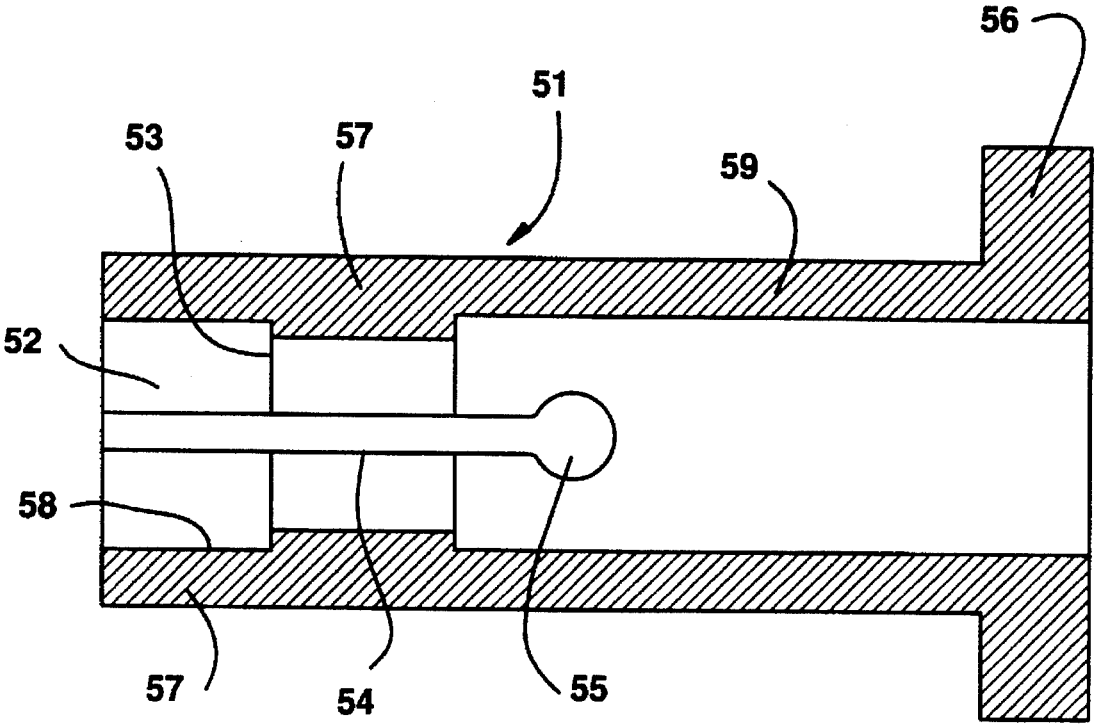
FIG. 9 shows a holding device with incision.

FIG. 9 shows a cross-section of a holding device 51. It essentially comprises a tubular body. Formed thereupon is a holding ring 56, by which the holding device 51 can be fastened on a tool base plate 520 (see FIG. 10). Inside the holding device 51 there is formed a stop 53, which supports in the axial direction a tube 510 to be expanded (see FIG. 12) and is able to absorb the forces occurring during the expanding operation. In the radial direction, the tube 510 is held by lateral guides 57, the tube 510 bearing against the abutment 58. The fitting of the tube 510 into the holding device 51 is facilitated by an insertion funnel 52. The holding device 51 is provided in the region of the insertion funnel 52, the abutment 58, the stop 53 and part of the basic body 59 of the holding device 51 in the axial direction with an incision 54, at the foot of which there is a bore 55. Due to this incision 54, the lateral guides 57 are formed in one piece onto the basic body 59 like leaf springs. If, during expanding, the diameter of the tube 510 is then enlarged, the lateral guides 57 spring outward. After removing the tube 510 from the holding device 51, the lateral springs 57 return into their initial position.

Figure 10:
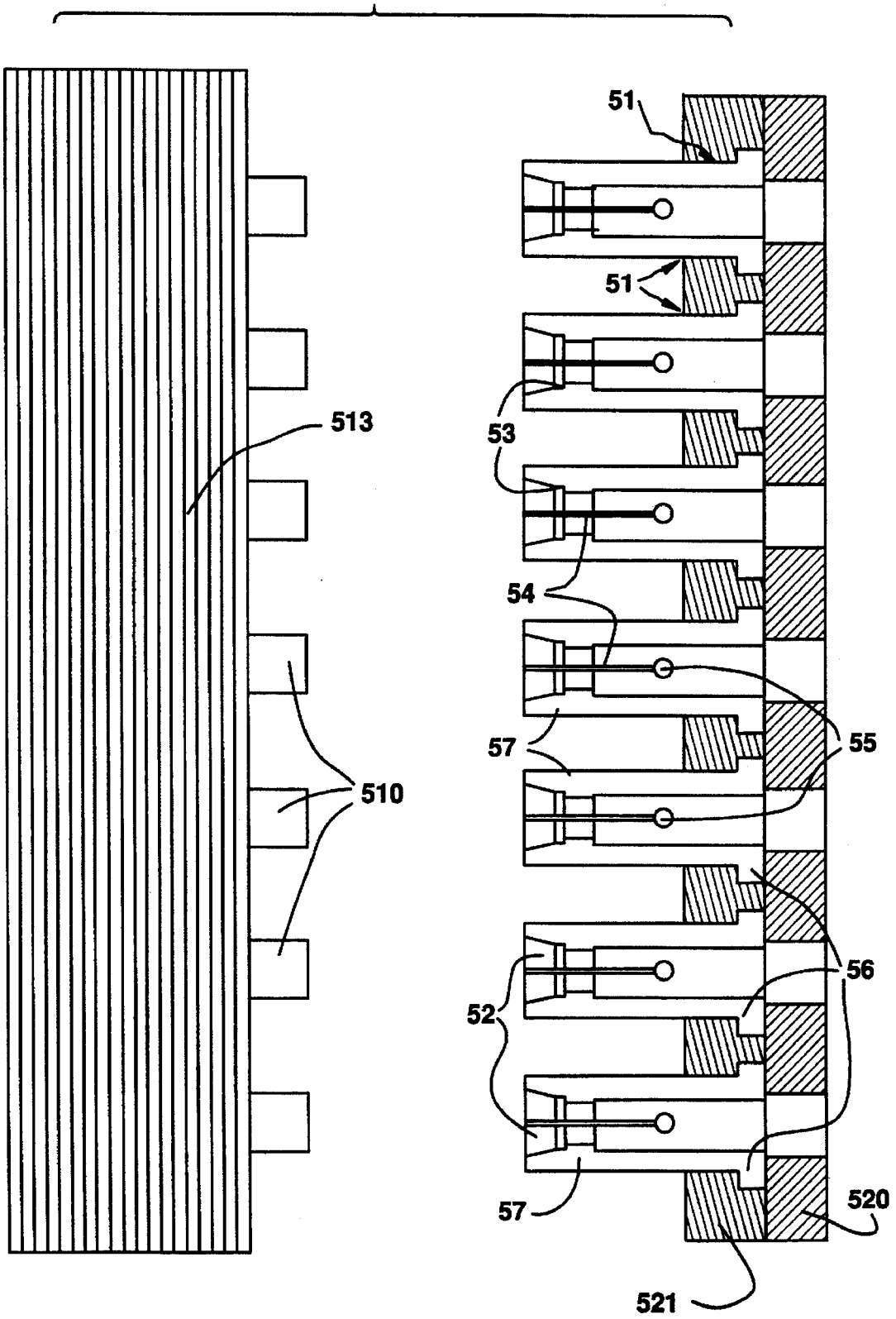
FIG. 10 shows an apparatus for mechanical expanding, with a heat exchanger block.

FIG. 10 shows an apparatus for mechanical expanding, having an arrangement of seven holding devices 51 on a base plate 520 and a heat exchanger block 513 with pushed-in tubes 510. The holding devices 51 are arranged on the base plate 520 at the same axial spacing as that exhibited by the tubes 510 in the heat exchanger block 513 and are fixed to a holding plate 521, the holding rings 56 being firmly clamped between the base plate 520 and the holding plate 521. For expanding, the heat exchanger block 513 is fitted by the tubes 510 into the holding devices 51, the tubes 510 not being pre-expanded. Subsequently, drawing mandrels 511 with their expanding elements 512 (See FIG. 11) are drawn in one action through the heat exchanger block 513 and the base plate 520. Subsequently, the heat exchanger block 513 mechanically joined together in its finished form can be removed.

Figure 11:
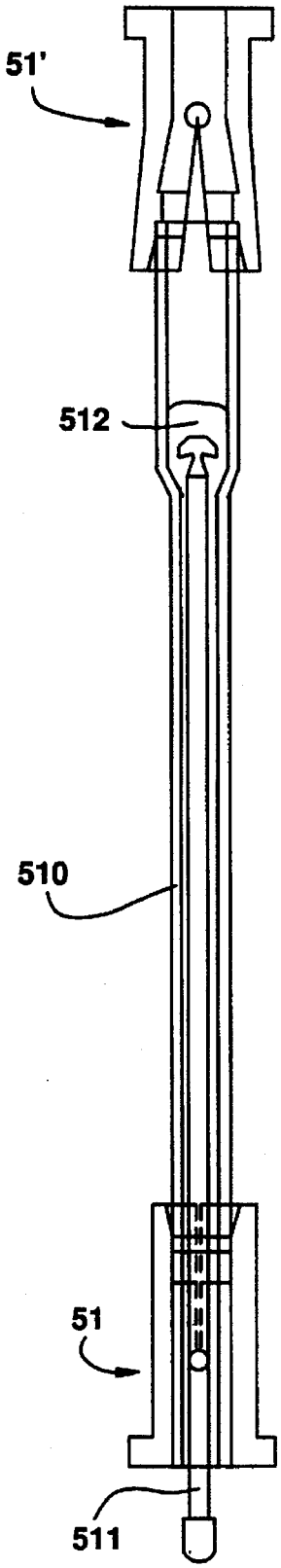
FIG. 11 shows holding devices with a tube, drawing mandrel and expanding element.

FIG. 11 shows a tube 510 during expanding. The tube 510 is held in two holding devices 51, 51'. A drawing mandrel 511 with an expanding element 512 is drawn through the tube 510, the tube 510 being expanded. The holding device 51', through which the expanding element 512 has already been drawn, has been spread open radially outward by the expanding of the tube 510.

Figure 12:
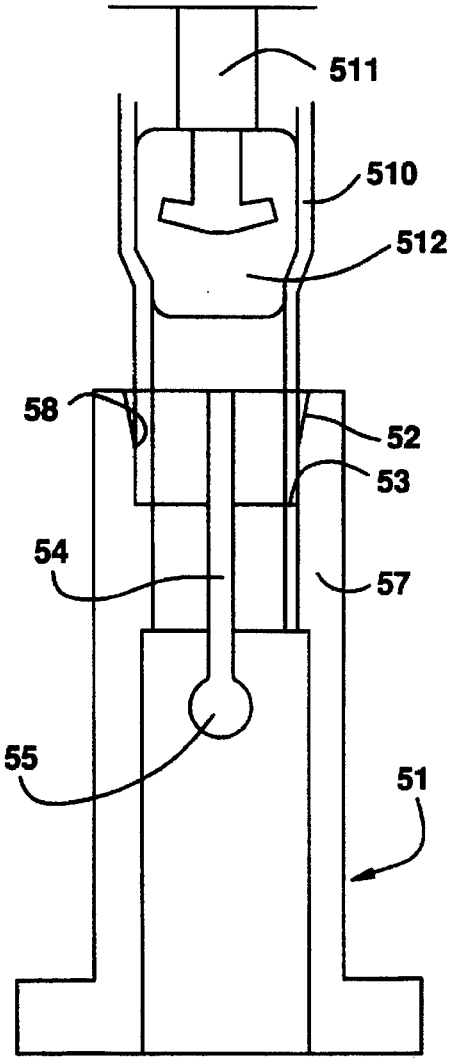
FIG. 12 shows a holding device with a tube end, drawing mandrel and expanding element.

FIG. 12 shows the tube 510, fitted into the holding device 51, during expanding. The stop 53 absorbs the axial forces which occur due to the pushing through of the expanding element 512. The lateral guides 57 are only spread open outward by the expanding of the tube 510, so that the axial forces are absorbed during the entire expanding operation.

Figure 13:
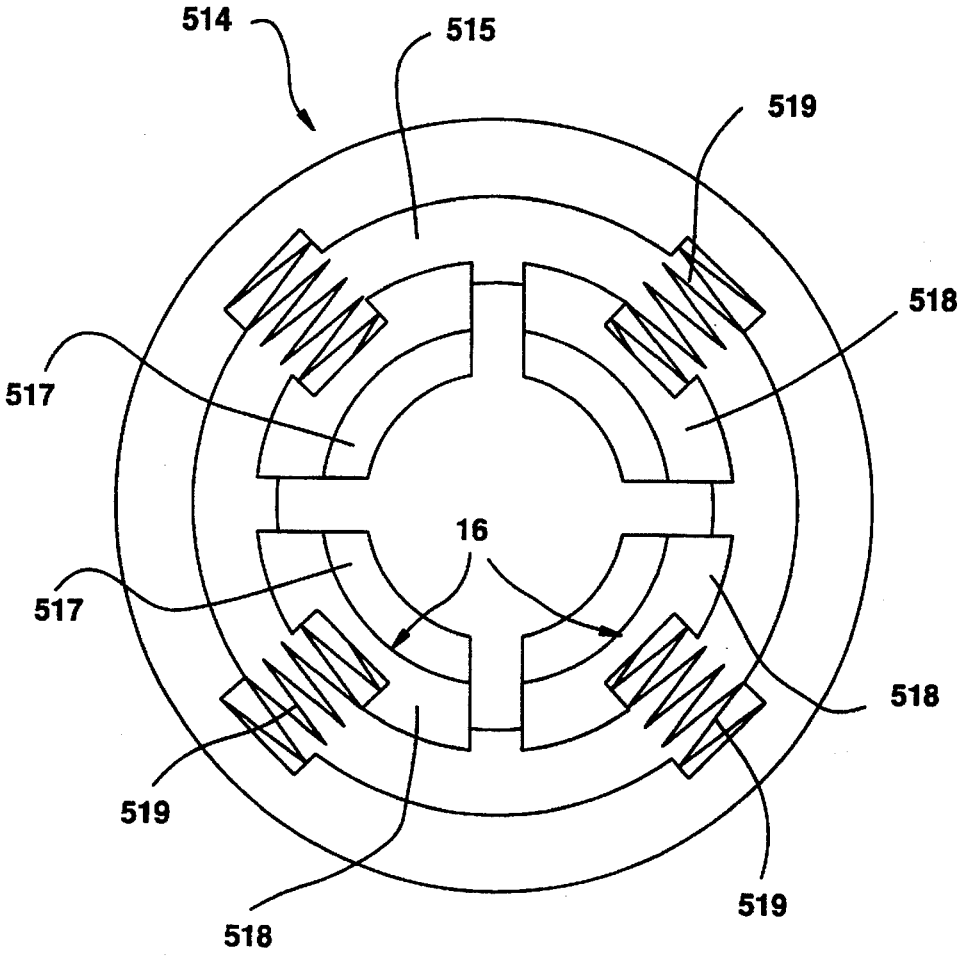
FIG. 13 shows a holding device with movably mounted holding elements and springs.

FIG. 13 shows a holding device 514 with movably mounted holding elements 518 and helical springs 519. In this case, the holding elements 518 are mounted in the tubular holding device 514 by the springs 519, the springs 519 being fixed in recesses. Instead of the springs 519, elastomerically compliant materials may also be used here, for example rubber blocks or rings. The axial forces which occur during expanding are transferred from the fitted tube (not shown) to the stops 517, which in turn introduce these forces into the supporting ring 515 of the holding device 514. The radial forces for securing the tube are applied by the springs 519 and transferred to the tube via the abutting surfaces 516.

Figure 14:
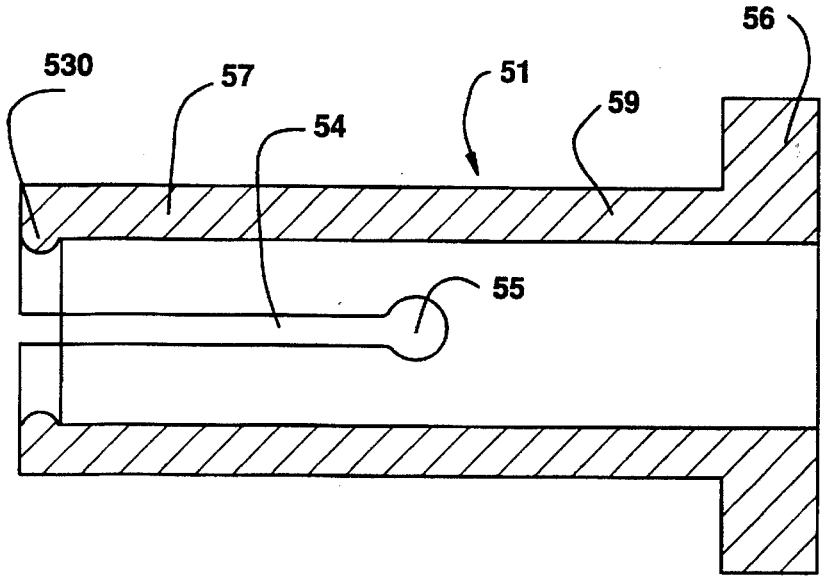
FIG. 14 shows a holding device with a bead around the internal periphery.

FIG. 14 shows a holding device 61 similar to the holding device 51 shown in FIG. 9. The holding device 61 includes a holding ring 66, a basic body 69, a bore 65, an incision 64 and lateral guides 67. In contrast to the holder 51 shown in FIG. 9, the holder 61 in FIG. 14 includes a thickening or bead 630 that runs along the internal periphery of the holding device 61. The bead 630 is integrally molded to the ends of the lateral guides 67. In the expansion method using the holder 61, the expansion element is pulled through the metal pipe inserted in the holding device 61, and the metal pipe is expanded radially. In so doing, the metal pipe is constricted slightly in the region of the thickening or bead 630. As a result of this constriction, the forces which are required for holding the pipe in the holding device 61 do not have to be provided exclusively by frictional forces, but can be taken up partly by positive locking.

In each of the methods described, the pre-expansion element 6 can be pushed into the ends of the expanded pipe, to avoid squashing the pipe ends. However, if the nature of the material of the pipe ends is such that the ends withstand the circumferential pressure of the holding devices, then the introduction of pre-expansion elements is not necessary.

While the invention has been described with reference to certain preferred embodiments, numerous modifications, alterations, and changes to the preferred embodiments are possible without departing from the spirit and scope of the invention, as defined in the appended claims and equivalents thereof.

What is claimed is:

1. A device for fastening metal tubes to metal ribs, comprising:

an expansion element having at one end a mounting device having two hooks pointing toward a centerline of the expansion element;

wherein the expansion element includes at an opposite end a second mounting device having two hooks pointing toward the centerline of the expansion element.

2. The device as claimed in claim 1, further comprising a draw rod having at one end a suspension device having a hammer-like contour for engaging with the mounting device of the expansion element.

3. The device of claim 2, wherein the suspension device includes an undercut at its underside, an undercut angle ($\alpha$) being about 2° to 25°.

4. The device as claimed in claim 3, wherein the undercut angle is about 5°.

5. The device of claim 2 wherein the suspension device includes an undercut at its underside, the undercut having an approximate U-shape.

6. The device as claimed in claim 2, wherein the mounting device has lateral clearance relative to the suspension device so that the suspension device is movable on a sector of a circle about a center point.

7. The device as claimed in claim 2, wherein the draw rod is approximately band-shaped.

8. The device as claimed in claim 7, wherein a cross-section of the draw rod is slightly smaller than a cross-section of a hollow space enclosed by a metal tube to be expanded.

9. The device as claimed in claim 8, wherein the draw rod has flats on its longitudinal sides.

10. The device as claimed in claim 1, wherein top sides of the hooks of the mounting device have undercut angles ($\alpha$) which are about 2° to 25°.

11. The device as claimed in claim 10, wherein the undercut angles are about 5°.

12. An apparatus for mechanically expanding metallic tubes, comprising:

at least one drawing mandrel having an expanding element at one end thereof; and at least one holding device having an insertion funnel and a stop, for holding a metallic tube to be expanded by the expanding element;

wherein the holding device includes lateral guides which are resiliently compliant outward in the radial direction;

the apparatus further comprising a base plate;

a holding plate; and a plurality of holding devices having holding rings and arranged on the base plate at the same axial spacing as the metallic tubes to be expanded;

wherein the plurality of holding devices are firmly clamped by their holding rings between the base plate and the holding plate.

13. The apparatus as claimed in claim 12, wherein the holding device includes in a region of the lateral guides in the axial direction at least one incision, the lateral guides being connected in one piece with the holding device and being resiliently compliant outward.

14. The apparatus as claimed in claim 13, wherein the incision includes a bore at one end thereof.

15. The apparatus as claimed in claim 12, wherein the holding device further comprises at least two radially outwardly movably mounted holding elements with lateral guides; and springs that press inward on the holding elements.

16. An apparatus for mechanically expanding metallic tubes, comprising:

at least one drawing mandrel having an expanding element at one end thereof; and at least one holding device having an insertion funnel and a stop, for holding a metallic tube to be expanded by the expanding element;

wherein the holding device includes lateral guides which are resiliently compliant outward in the radial direction; and wherein the holding device further comprises at least two radially outwardly movably mounted holding elements with lateral guides; and springs that press inward on the holding elements;

the apparatus further comprising:

a base plate;

a holding plate;

a plurality of holding devices having holding rings and arranged on the base plate at the same axial spacing as the metallic tubes to be expanded;

wherein the holding devices are firmly clamped by their holding rings between the base plate and the holding plate.

17. An apparatus for mechanically expanding metallic tubes, comprising:

at least one drawing mandrel having an expanding element at one end thereof; and at least one holding device for holding a metallic tube to be expanded by the expanding element, the holding device including a bead around an internal periphery thereof;

wherein the holding device includes lateral guides which are resiliently compliant outward in the radial direction;

the apparatus further comprising a base plate;

a holding plate; and a plurality of holding devices having holding rings and arranged on the base plate at the same axial spacing as the metallic tubes to be expanded;

wherein the plurality of holding devices are firmly clamped by their holding rings between the base plate and the holding plate.

18. The apparatus of claim 17, wherein the holding device includes in a region of the lateral guides in the axial direction at least one incision, the lateral guides being connected in one piece with the holding device and being resiliently compliant outward.

19. The apparatus of claim 18, wherein the incision includes a bore at one end thereof.

20. The apparatus of claim 18, wherein the bead is integrally molded to ends of the lateral guides.

* * * * *